US011228132B2

(12) United States Patent
Sargis et al.

(10) Patent No.: US 11,228,132 B2
(45) Date of Patent: Jan. 18, 2022

(54) SINGLE PAIR ETHERNET FIELD TERMINABLE CONNECTOR

(71) Applicant: Panduit Corp., Tinley Park, IL (US)

(72) Inventors: Adam Sargis, Frankfort, IL (US); Michael R. Walters, Crown Point, IN (US); Michael B. Verbeek, Chicago, IL (US); Gabriela R. Sims, Gary, IN (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/908,125

(22) Filed: Jun. 22, 2020

(65) Prior Publication Data

US 2021/0006002 A1 Jan. 7, 2021

Related U.S. Application Data

(60) Provisional application No. 62/869,312, filed on Jul. 1, 2019.

(51) Int. Cl.

| | |
|---|---|
| ***H01R 13/502*** | (2006.01) |
| ***H01R 13/623*** | (2006.01) |
| ***H01R 24/20*** | (2011.01) |
| ***H01R 13/6581*** | (2011.01) |
| *H01R 103/00* | (2006.01) |

(52) U.S. Cl.

CPC ..... *H01R 13/502* (2013.01); *H01R 13/623* (2013.01); *H01R 13/6581* (2013.01); *H01R 24/20* (2013.01); *H01R 2103/00* (2013.01)

(58) Field of Classification Search

CPC ..... H01R 13/502; H01R 13/623; H01R 13/6581; H01R 24/20; H01R 2103/00

USPC ..... 439/362

See application file for complete search history.

(56) References Cited

U.S. PATENT DOCUMENTS

| | | | | |
|---|---|---|---|---|
| 3,772,637 | A | 11/1973 | Paullus et al. | |
| 3,816,641 | A | 6/1974 | Iverson | |
| 4,060,229 | A | 11/1977 | Carter | |
| 4,163,598 | A | 8/1979 | Bianchi et al. | |
| 5,100,341 | A | 3/1992 | Czyz et al. | |
| 5,954,541 | A * | 9/1999 | Ozai | H01R 13/6585 439/607.05 |
| 6,238,246 | B1 * | 5/2001 | Ferrill | H01R 9/035 439/607.47 |
| 6,287,149 | B1 * | 9/2001 | Elkhatib | H01R 13/5804 439/417 |

(Continued)

*Primary Examiner* — Peter G Leigh

(74) *Attorney, Agent, or Firm* — Christopher S. Clancy; James H. Williams; Christopher K. Marlow

(57) ABSTRACT

A communications connector has a middle barrel, top sled, and bottom sled. The top sled has a top wire opening and a top insulation displacement contact (IDC) hole with the top IDC hole providing access to a wire inserted into the top wire opening. The top sled has a top IDC channel containing a top IDC. The bottom sled has a bottom wire opening and a bottom IDC hole with the bottom IDC hole providing access to a wire inserted into the bottom wire opening. The bottom sled also has a bottom IDC channel with a bottom IDC. The top and bottom sleds are can be fitted together and inserted into the middle barrel with the top IDC engaging a wire inserted into the bottom wire opening through the bottom IDC hole and the bottom IDC engaging a wire inserted into the top wire opening through the top IDC hole.

5 Claims, 11 Drawing Sheets

(56) References Cited

U.S. PATENT DOCUMENTS

| | | | | |
|---|---|---|---|---|
| 6,328,601 | B1 * | 12/2001 | Yip | H01R 13/465 439/607.08 |
| 6,358,091 | B1 * | 3/2002 | Lo | H01R 13/6585 439/607.06 |
| 6,783,386 | B2 | 8/2004 | Clement | |
| 7,249,979 | B2 * | 7/2007 | Gerber | H01R 4/2429 439/676 |
| 7,540,789 | B2 * | 6/2009 | Gerber | H01R 4/2429 439/676 |
| 7,572,140 | B2 * | 8/2009 | Szelag | H01R 4/2433 439/405 |
| 8,070,506 | B2 * | 12/2011 | De Dios Martin | H01R 13/506 439/409 |
| 8,096,833 | B2 * | 1/2012 | Tobey | H01R 13/518 439/607.23 |
| 8,192,224 | B2 * | 6/2012 | Schmidt | H01R 24/64 439/409 |
| 8,215,980 | B1 * | 7/2012 | Lin | H01R 4/2433 439/404 |
| 8,573,999 | B2 * | 11/2013 | Feldner | H01R 24/64 439/409 |
| 10,148,048 | B2 * | 12/2018 | Larsson | H01R 13/6463 |
| 2006/0183359 | A1 | 8/2006 | Gerber et al. | |
| 2018/0248306 | A1 * | 8/2018 | Franke | H02G 15/013 |

* cited by examiner

SINGLE PAIR ETHERNET FIELD TERMINABLE CONNECTOR

CROSS REFERENCE TO RELATED APPLICATIONS

This application claims benefit to U.S. Provisional Patent Application No. 62/869,312, filed on Jul. 1, 2019, the entirety of which is hereby incorporated by reference herein.

BACKGROUND

Industrial and building automation applications have long used single pair cable systems to deliver power and very low bandwidth data transmission. A typical deployment of this cable would be terminated to various devices using screw terminals. A modern solution is needed to support ethernet data transmission and power transmission capabilities. This solution must be able to withstand the extreme environments that exist at the edge of the network on harsh factory floors to support machinery.

As the desire to replace legacy protocols grows, an Ethernet-based solution can provide higher-speed data transfer and the ability to power devices at the edge of the network. This solution will be used at the edge of the network, connecting to final control devices such as valves, switches, actuators, drives, and other control panel components.

What is needed is a termination design that holds a small form factor that can be manufactured inexpensively. The solution must also be quickly terminated without the need for complex tools.

SUMMARY OF THE INVENTION

A communications connector has a middle barrel, top sled, and bottom sled. The top sled has a top wire opening and a top insulation displacement contact (IDC) hole with the top IDC hole providing access to a wire inserted into the top wire opening. The top sled has a top IDC channel containing a top IDC. The bottom sled has a bottom wire opening and a bottom IDC hole with the bottom IDC hole providing access to a wire inserted into the bottom wire opening. The bottom sled also has a bottom IDC channel with a bottom IDC. The top and bottom sleds are configured to be fitted together and inserted into the middle barrel with the top IDC engaging a wire inserted into the bottom wire opening through the bottom IDC hole and the bottom IDC engaging a wire inserted into the top wire opening through the top IDC hole.

DESCRIPTION OF THE INVENTION

The present invention features a M8 body with the ability to terminate a single pair ethernet (SPE) cable to a connector that establishes electrical continuity and provides strain relief for the cable. This connector is meant to hold an IP 67 rating and be used in harsh environments on network edge devices. The SPE M8 connector also incorporates a means of shielding to improve the electrical performance of the connector in high noise (EMC) environments.

Figure 1:
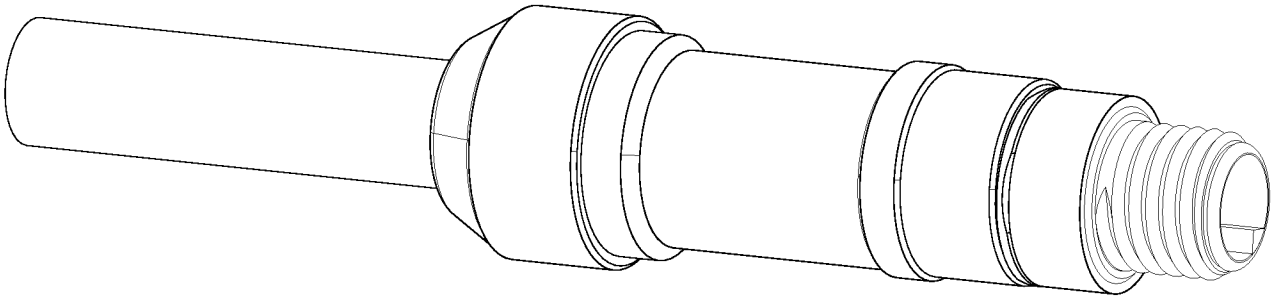
FIG. 1 shows an isometric view of an M8 style communications connector.

FIG. 1 presents the M8 style single pair connector fully assembled.

Figure 2:
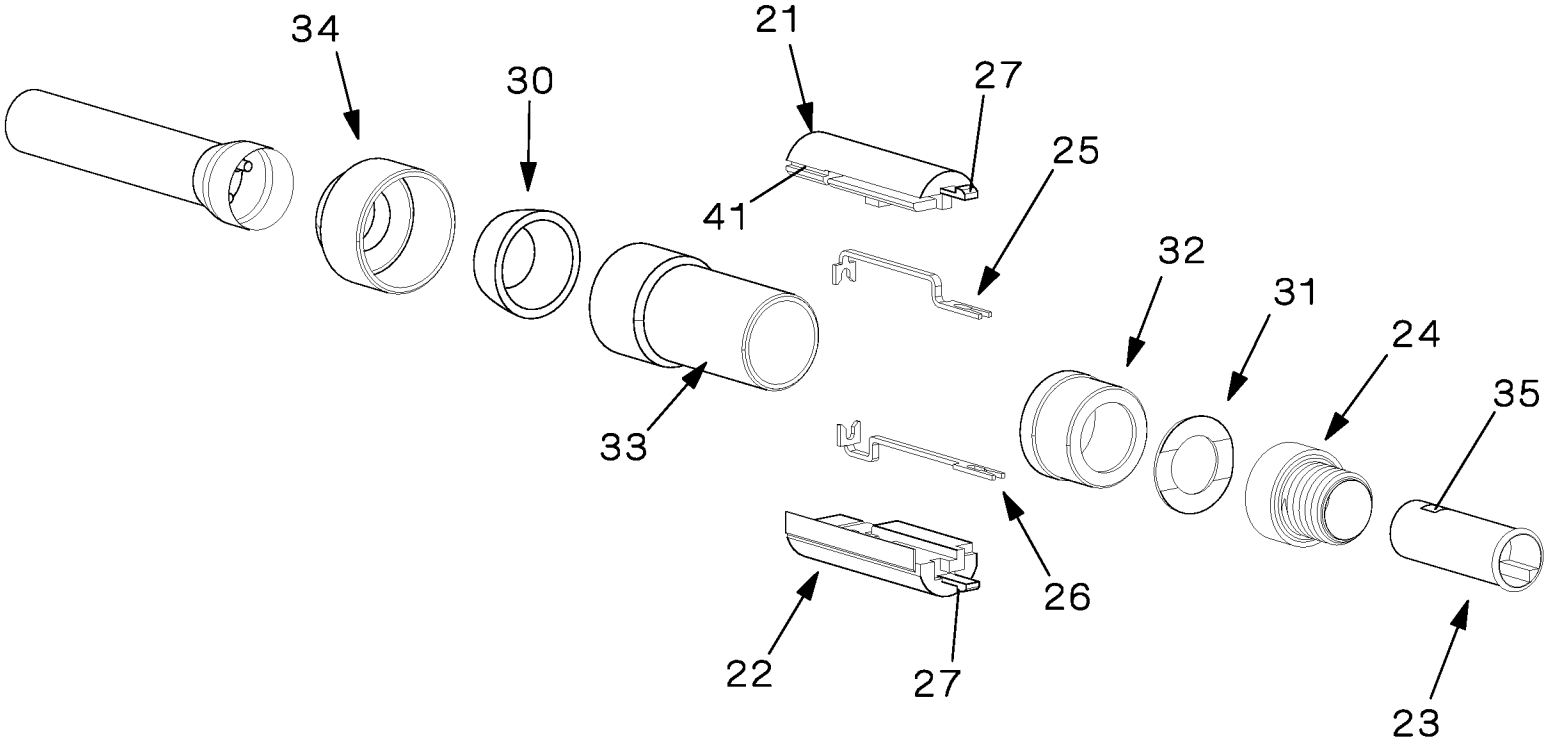
FIG. 2 is an exploded isometric view of the connector of FIG. 1.

FIG. 2 shows an exploded view of the connector. The M8 housing features five different metal pieces: the mating screw 24, wave washer 31, front mating housing 23, middle barrel 33 and bottom cap 34. The IDCs (Insulation Displacing Contact) 25 & 26 run parallel to provide stronger coupling between differential pairs as well as assist in rejection of alien crosstalk and any outside noise. There is a rubber seal 30 that seats between the bottom cap and the middle barrel. Strain relief is provided by the sleds 21 & 22 as well as the middle barrel 33 and the bottom cap 34. The rubber seal 30 provides tension that prevents the cable from separating from the connector. The wave washer 31 provides a shielded ground connection between the front housing 32 and the mating screw 24. The latches 27 that snap into the indent 35 of the front mating housing 23 can also be seen here.

Figure 3:
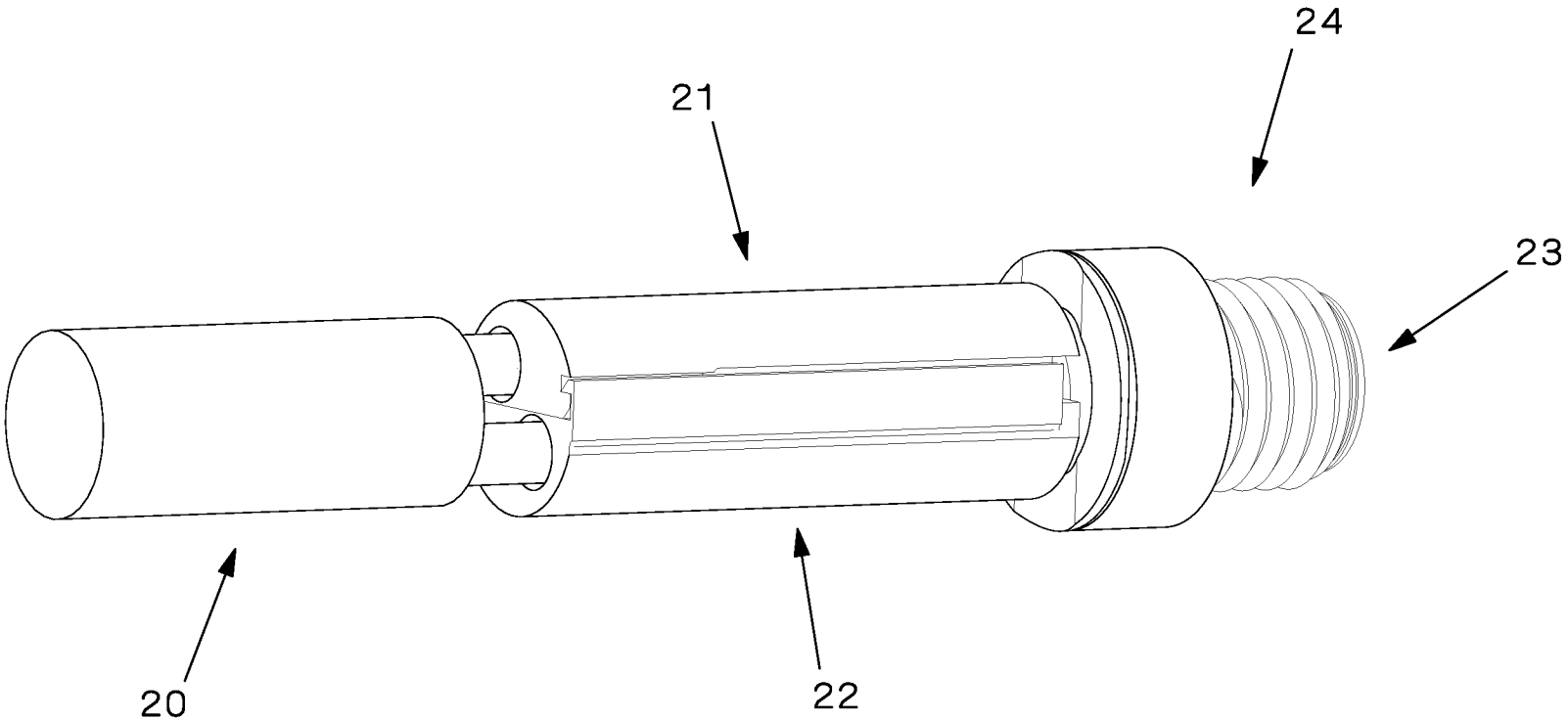
FIG. 3 is an isometric view of a partial assembly of the connector of FIG. 1 highlighting the securing of the top and bottom sleds.

FIG. 3 depicts the 18 AWG single pair wire 20 installed inside of the top sled 21 and bottom sled 22. These sleds hold the IDCs 25 & 26 in place. As the sleds are pressed together, the IDCs are able to displace the insulation and make an electrical connection with the stranded wire.

Figure 4:
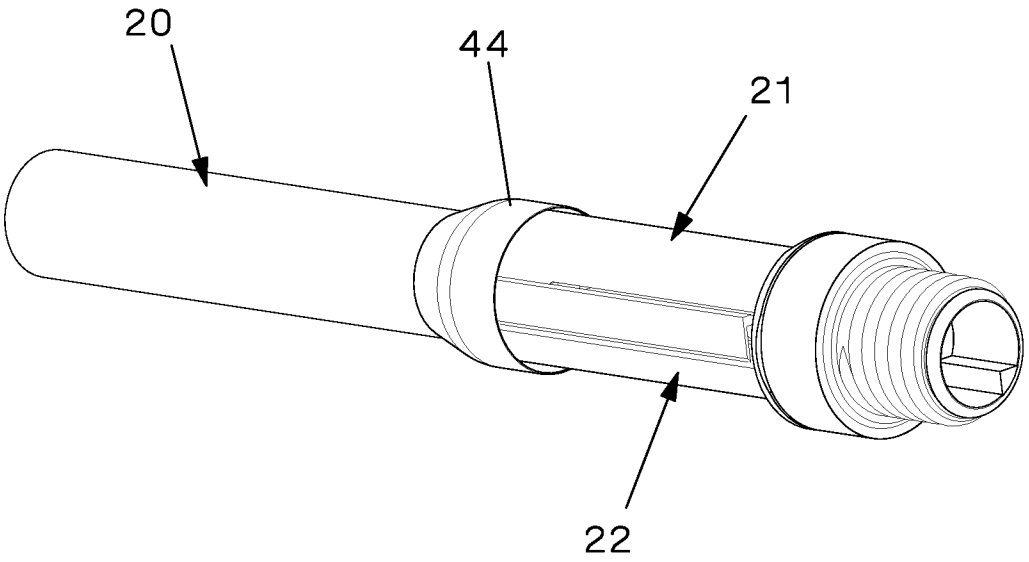
FIG. 4 is another isometric view of the partial assembly of FIG. 3.

FIG. 4 shows the 360 degree shield 44 from the wire being wrapped around the two sleds 21 & 22 after they have been snapped together. This shield then touches off and makes contact with the middle barrel (hidden from view for clarity). Shielding that features 360 degrees of contact is the best way to ensure that noise is mitigated.

Figure 5:
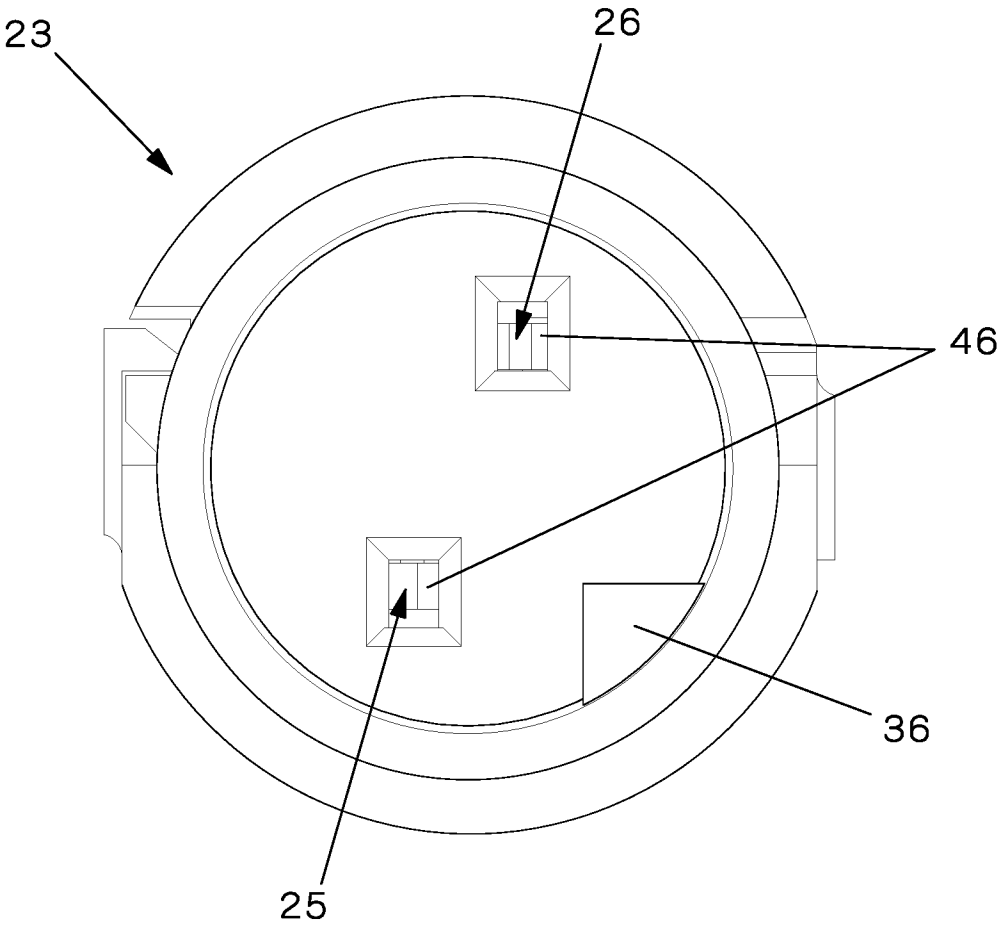
FIG. 5 is a front view of the partial assembly of FIG. 3.

FIG. 5 shows the front mating housing 23 of the connector. There is a key feature 36 to ensure the connector is inserted correctly to a female M8 connector. Contact openings 46 provide access to the IDCs.

Figure 6:
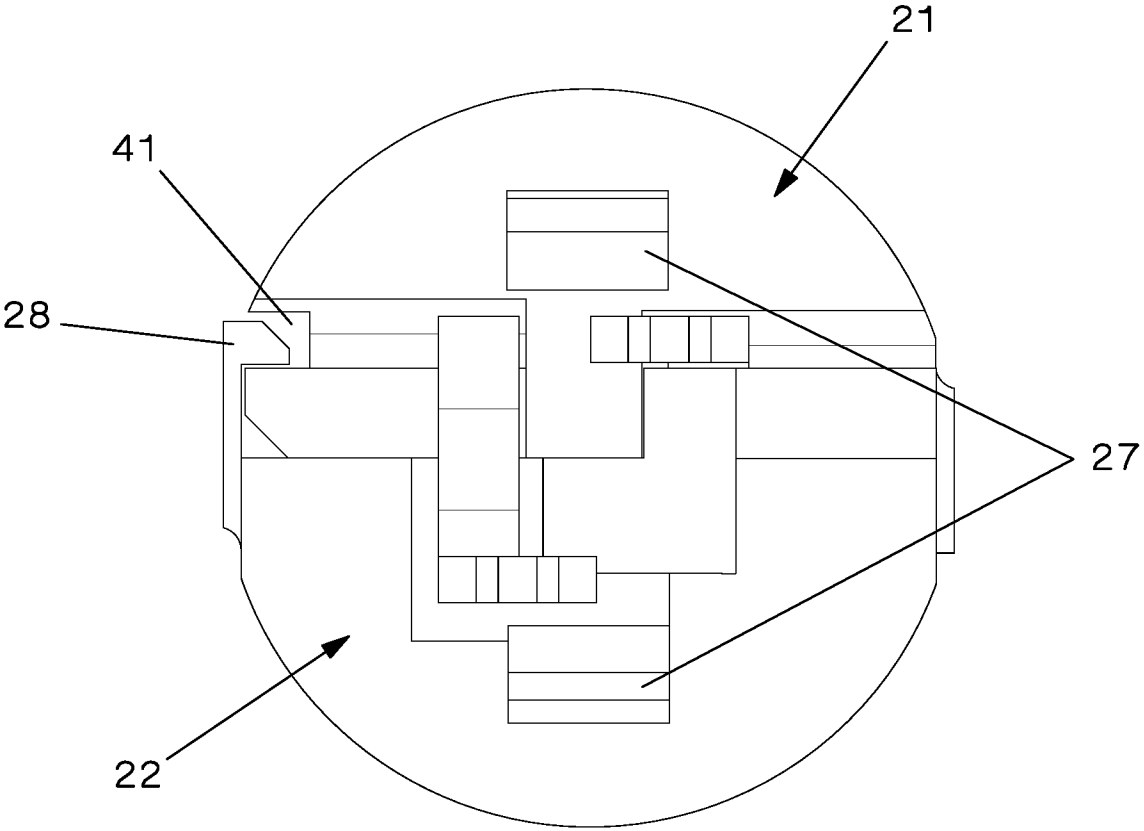
FIG. 6 is a front view of the top and bottom sleds after they are secured together.

FIG. 6 provides a front view of the two sleds when they are connected together as well as the pin layout as it protrudes out of the sleds when they are pressed together. The channel 41 in which the IDC sits in the top sled 21 is the same channel in which the side snap 28 seats in to secure the sleds together. The latches 27 that hold the front mating housing are displayed.

Figure 7:
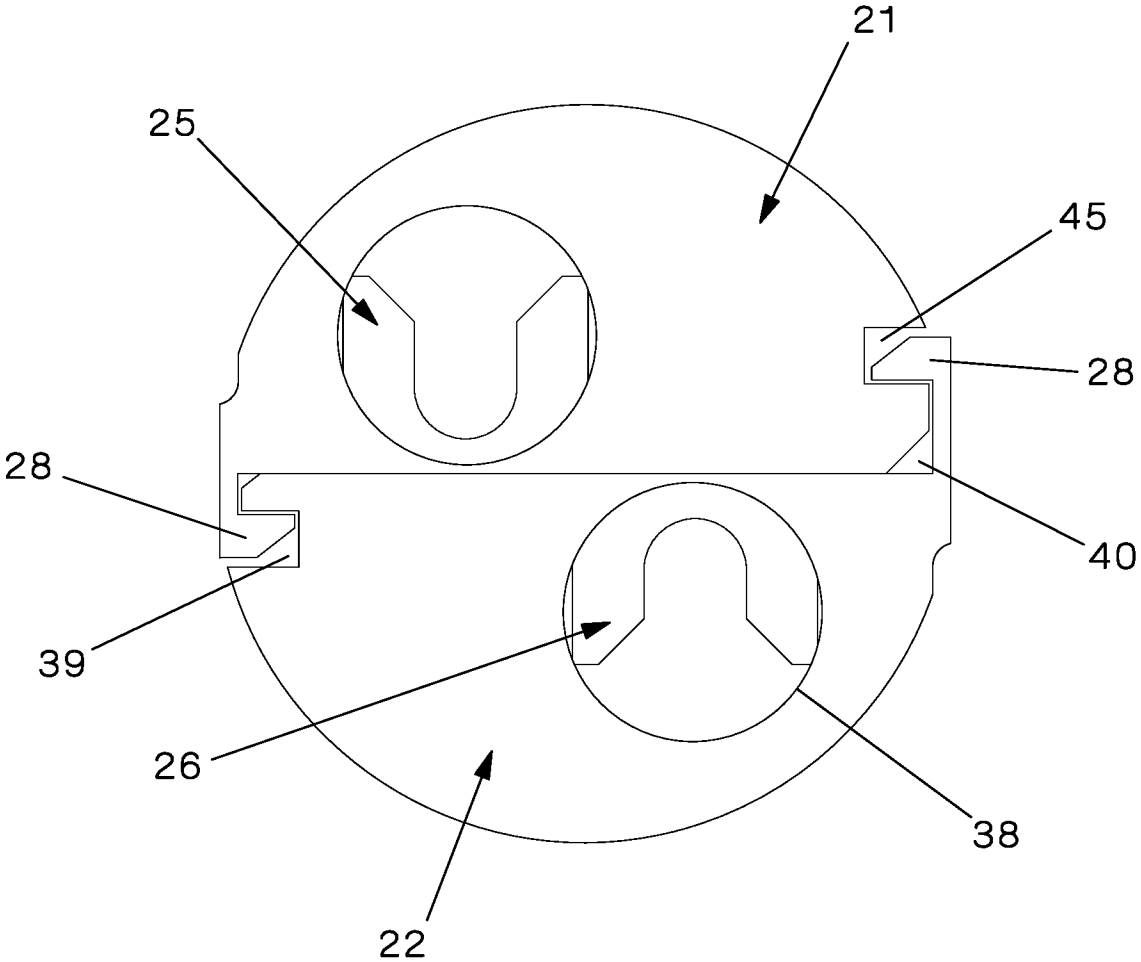
FIG. 7 is a rear view of the top and bottom sleds after they are secured together.

FIG. 7 shows a rear view of the sleds snapped together with a clear view of where the wires are inserted through the circular openings 38. The IDCs 25 & 26 can be seen from the holes with no wire inserted. The side snaps 28 slide over the indentation feature 40 and into the channels 39 & 45 on each sled to secure the sleds together. The snap motion does not require any tools and can be engaged by hand. The IDC is held by a shared channel that is partially used to latch sleds together but is also used by the IDC.

Figure 8:
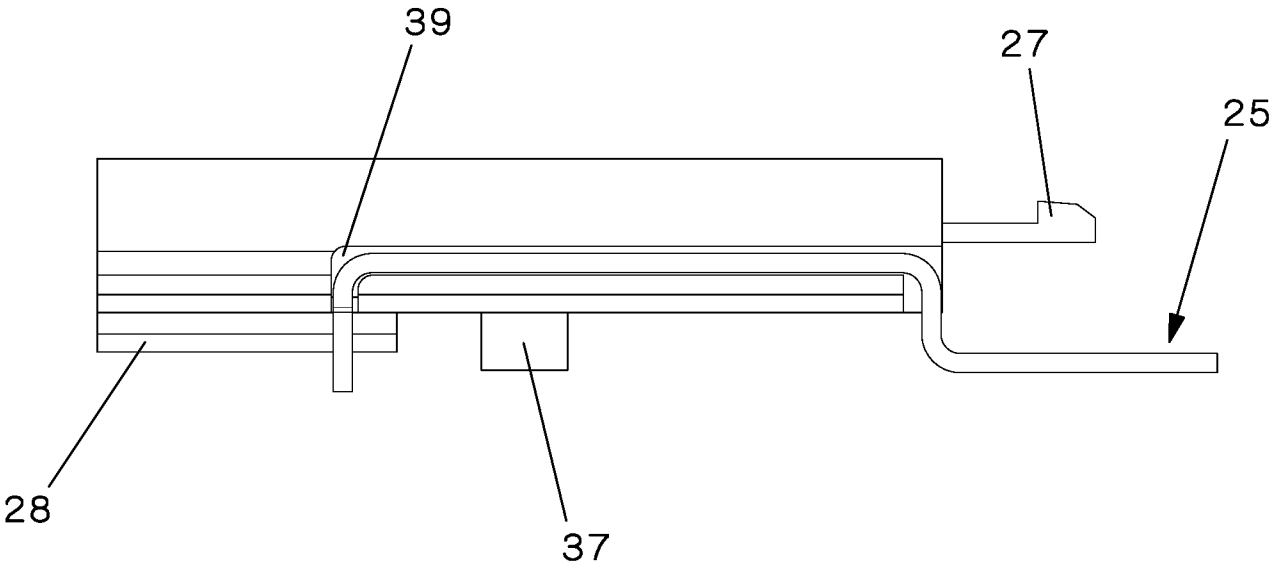
FIG. 8 is a side view of the top sled of the connector of FIG. 1
Figure 9:
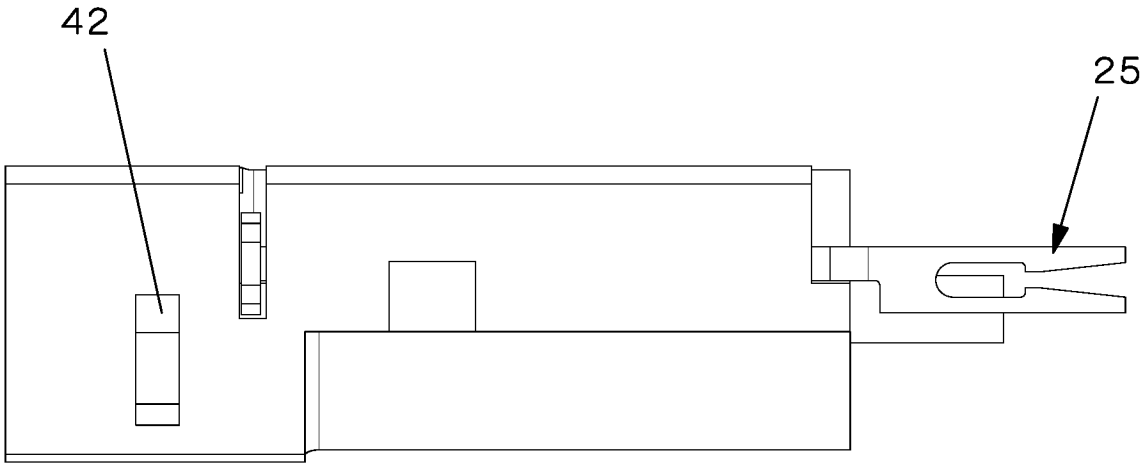
FIG. 9 is another side view of the top sled of FIG. 8.

The top sled 21 is shown in detail in FIGS. 8 & 9. Box feature 37 maintains orientation of the sleds as they are snapped together. The box feature also prevents the bottom sled's IDC from shifting during termination. The IDC hole 42 is where the IDC from the bottom sled will go through to terminate the wire held inside.

Figure 10:
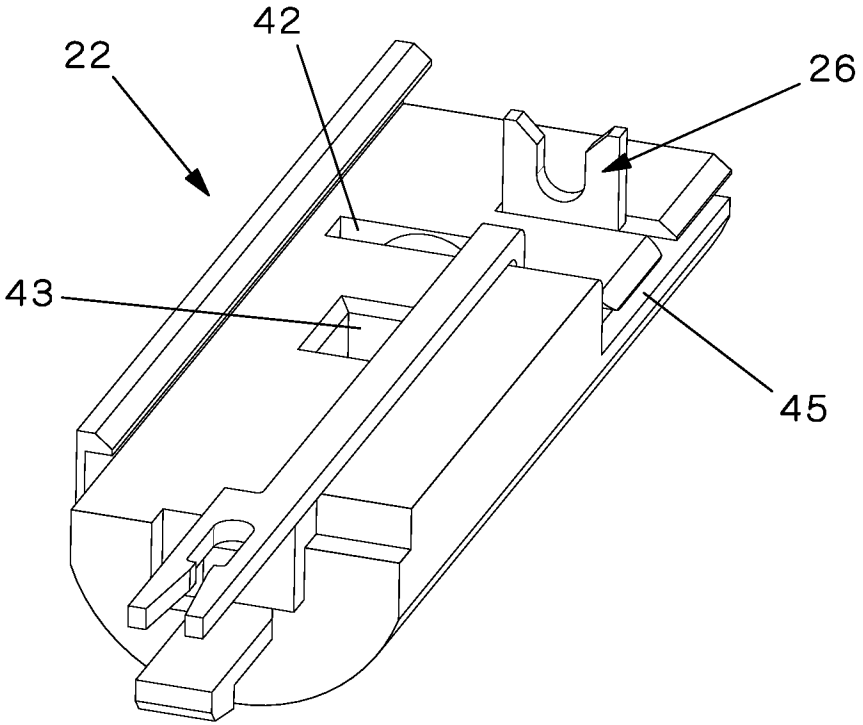
FIG. 10 is an isometric view of bottom sled of the connector of FIG. 1.
Figure 11:
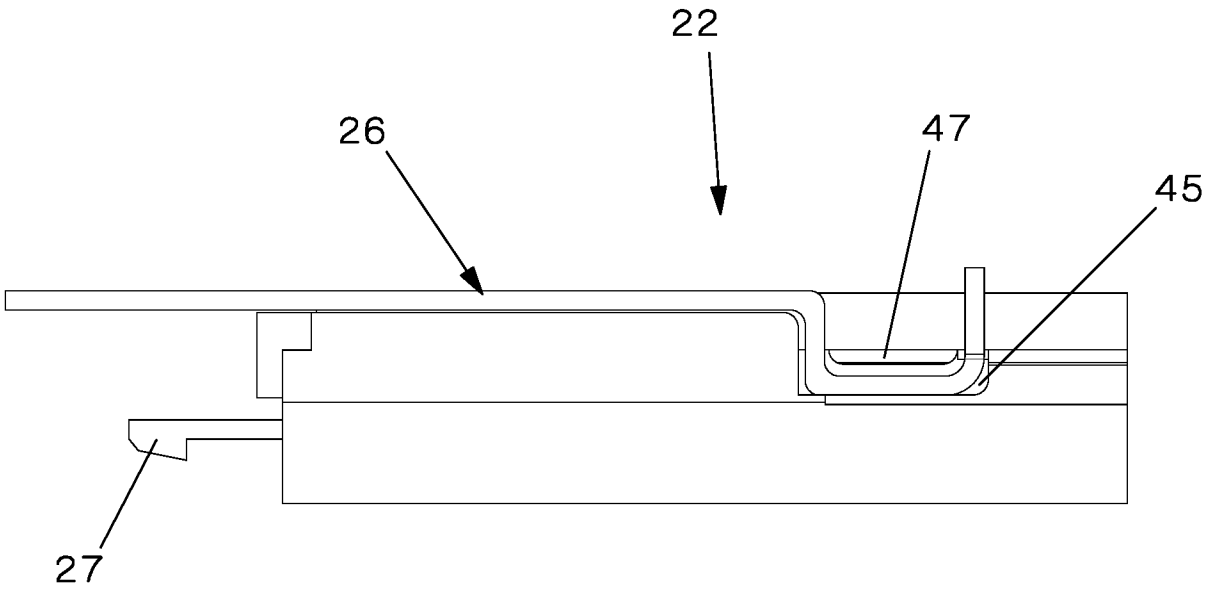
FIG. 11 is a side view of the bottom sled of FIG. 10.

FIGS. 10 & 11 provides an ISO (FIG. 10) and side view (FIG. 11) of the bottom sled 22 and IDC 26. The opening 43 that accepts the box feature 37 from the top sled 21. The bottom channel 39 is where the bottom IDC 26 is seated in the sled. This channel is shorter in length than the top channel on the top IDC but features a curve 47 to keep the IDC in place. The curve of the IDC allows the two IDCs to run in parallel for half of the sled length.

The termination method is as follows:

1. Strip wire back;
2. Ready sleds by installing IDCs;
3. Place back cap and rubber boot on wire;
4. Insert wire into dedicated wire holes inside of the connector halves;
5. Press sleds together until the latches engage;
6. Put middle barrel over the full connector and screw into front housing;
7. Roll shielding between fingers and insert it into the space between the middle barrel and sled;
8. Screw bottom cap onto middle barrel with rubber boot in between the bottom cap and the middle barrel;
9. Insert the full connector into the front housing of the connector with wave washer installed; and
10. Tighten screws together.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

The invention claimed is:

1. A communications connector comprising:

a middle barrel;

a top sled, the top sled having a top circular opening and a top insulation displacement contact (IDC) hole, the top IDC hole providing access to a top wire inserted into the top wire opening, and a top IDC channel containing a top IDC; and a bottom sled having a bottom circular opening and a bottom IDC hole, the bottom IDC hole providing access to a bottom wire inserted into the bottom wire opening, and a bottom IDC channel with a bottom IDC wherein the top and bottom sleds are configured to be fitted together and inserted into the middle barrel and further wherein the top IDC is configured to engage the bottom wire and the bottom IDC is configured to engage the top wire further comprising a front mating housing secured to the top and bottom sleds and further comprising a front housing and a mating screw.

2. The communications connector of claim 1 further comprising latching features integrated into the top IDC channel and the bottom IDC channel configured to aide in securing the top sled to the bottom sled.

3. The communications connector of claim 1 further comprising side latching features on the top and bottom sleds configured to secure the top and bottom sleds together.

4. The communications connector of claim 1 wherein the front mating housing is connected to the top and bottom sleds via latches located on the top and bottom sleds.

5. The communication connector of claim 1 further comprising a wave washer configured to provide a shielded ground connection between the front housing and the mating screw.

* * * * *